United States Patent [19]

Aketa et al.

[11] Patent Number: 4,848,658

[45] Date of Patent: Jul. 18, 1989

[54] PRESSURE ACCUMULATION TYPE OF FUEL INJECTION DEVICE FOR AN INTERNAL COMBUSTION ENGINE

[75] Inventors: Masahiro Aketa; Satoshi Fujii, both of Osaka, Japan

[73] Assignee: Kubota Ltd., Osaka, Japan

[21] Appl. No.: 58,947

[22] Filed: Jun. 4, 1987

[30] Foreign Application Priority Data

Jun. 6, 1986 [JP] Japan ..... 61-132139

[51] Int. Cl.[4] ..... F02M 47/02

[52] U.S. Cl. ..... 239/88; 239/96

[58] Field of Search ..... 239/88, 89, 96, 533.3–533.12, 239/91

[56] References Cited

U.S. PATENT DOCUMENTS

| | | | |
|---|---|---|---|
| 2,985,378 | 5/1961 | Falberg | 239/96 |
| 3,442,451 | 5/1969 | De Nagel | 239/96 |
| 3,477,648 | 11/1969 | Roosa | 239/533.4 |
| 3,913,537 | 10/1975 | Ziesche et al. | 239/96 |
| 4,200,231 | 4/1980 | Knape | 239/96 |
| 4,436,247 | 3/1984 | Akagi | 239/533.7 |
| 4,561,590 | 12/1985 | Akagi | 239/96 |
| 4,605,166 | 8/1986 | Kelly | 239/96 |
| 4,628,881 | 12/1986 | Beck et al. | 239/96 |

*Primary Examiner*—Andres Kashnikow
*Assistant Examiner*—Michael J. Forman
*Attorney, Agent, or Firm*—Lowe, Price, LeBlanc, Becker & Shur

[57] ABSTRACT

In a pressure accumulation type of fuel injection device for an internal combustion engine, including a fuel injector which is adapted to temporarily store each incoming charge of highly pressurized fuel and inject the fuel under high pressure, a nozzle valve is provided within the pressure accumulation chamber defined in the fuel injector body. The upper end portion of the nozzle valve stem extends hermetically and slidably through a bore formed in the fuel injector body. Furthermore, a cylindrical check valve is provided so as to encircle the valve stem and is adapted to be biased towards an underside of an annular projection formed on the valve stem by a check valve spring mounted on the valve stem to close the check valve. The spring force for closing the check valve which controls the opening and the closing of the inlet portion of the pressure accumulation chamber is reduced and the pressure of the fuel stored in the pressure accumulation chamber can be increased greatly. The fuel injection timing can thereby be controlled more accurately.

7 Claims, 3 Drawing Sheets

PRESSURE ACCUMULATION TYPE OF FUEL INJECTION DEVICE FOR AN INTERNAL COMBUSTION ENGINE

BACKGROUND OF THE INVENTION

1. Field of the Invention

The present invention relates to a pressure accumulation type of fuel injection device which has a pressure accumulation chamber defined in a fuel injector and adapted to store each incoming charge of highly pressurized fuel delivered from a fuel injection pump and is adapted to open a nozzle valve by the fuel pressure in the pressure accumulation chamber at the completion of the delivery stroke of the fuel injection pump so as to inject the fuel under high pressure through spray holes.

2. Background of the Prior Art

It is known in the art, for example per U.S. Pat. No. 4,561,590 and U.S. Pat. No. 4,436,247, that to have a pressure accumulation type of fuel injection device wherein each incoming charge of highly pressurized fuel delivered from a fuel injection pump is adapted to be stored temporarily in a pressure accumulation chamber defined in a fuel injector to thereafter be injected into a combustion chamber of an internal combustion engine at the completion of the delivery stroke of a fuel injection pump.

The device disclosed in U.S. Pat. No. 4,561,590 includes a nozzle valve arranged in a pressure accumulation chamber so as to close spray holes and a check valve arranged therein so as to block an inflow passageway into the pressure accumulation chamber. Between the upper end of the nozzle valve and the check valve there is provided a compression spring so that the valve stem of the check valve can slide reciprocatingly within a blind hole formed at the upper side of the nozzle valve. The nozzle valve can thus be reduced in weight to enhance the effectiveness. However, the device is constructed so that the blocking force of the check valve and the closing force of the nozzle valve are obtained by a single compression spring. The spring force of this spring therefore has to be very strong because it sets the fuel injection pressure. Therefore, some problems arise, e.g., it is impossible to store the highly pressurized fuel in the pressure accumulation chamber because the closing force of the check valve also becomes correspondingly very strong. On the other hand, since the upper end of the nozzle valve is arranged to be in communication with a fuel passageway (an inlet chamber) disposed at the upstream of the check valve via a throughhole formed within the stem of the check valve, the pressure receiving area for closing the nozzle valve becomes larger than that for opening it. Therefore, both the valve opening timing and the valve closing timing of the nozzle valve become unharmonious because small pressure variations in the inlet chamber have significant influence on the opening and the closing force for the nozzle valve.

On the other hand, the device disclosed in U.S. Pat. No. 4,436,247 has a cylindrical check valve fitted hermetically and slidably around a valve stem of a nozzle valve which is arranged within a pressure accumulation chamber, and a compression spring provided between the nozzle valve and the check valve. The upper end of the nozzle valve is adapted to extend to a fuel inflow passageway (an inlet chamber) disposed at the upstream of the check valve. Also, in this case, since the closing forces for the nozzle valve as well as the check valve are adapted to be obtained by a single compression spring, it is impossible to increase the fuel pressure which is stored in the pressure accumulation chamber. Further, since the upper end of the nozzle valve stem is extended into the inlet chamber, and the pressure receiving area for closing the nozzle valve becomes larger than that for opening it, the pressure variations in the inlet chamber influence the operating timing of the nozzle valve, that is, the opening timing and the closing timing of the nozzle valve become unpredictably unharmonious.

OBJECTS AND SUMMARY OF THE INVENTION

It is, therefore, an object of the present invention to provide a pressure accumulation type of fuel injector which is capable of injecting fuel under high pressure into a combustion chamber of an internal combustion engine.

Another object of the present invention is to provide a fuel injector which is capable of injecting fuel accurately.

The means of the present invention for accomplishing the above objects is a pressure accumulation type of fuel injection device for an internal combustion engine, which comprises a body of a fuel injector which is provided with spray holes and a pressure accumulation chamber in communication with a delivery port of a plunger pump through an inlet chamber and which has a bore formed in the upper wall of the inlet chamber for a nozzle valve stem to extend slidably therethrough, a nozzle valve which is biased towards the spray holes by a nozzle spring and the valve stem of which extends longitudinally through both the pressure accumulation chamber and the inlet chamber, the upper end portion of the valve stem extending hermetically and slidably through the bore of the fuel injector body, an annular projection formed on the valve stem within the inlet chamber, and a check valve of which cylindrical valve body encircles the valve stem of the nozzle valve while keeping a fuel passageway therebetween and is fitted hermetically and slidably within the injector body and which is biased against the lower surface of the annular projection by a check valve spring provided between the valve body and the valve stem of the nozzle valve.

Accordingly, in the above-mentioned aspect of injector, since the spring force for closing the check valve which controls the opening and the closing of the inlet portion to the pressure accumulation chamber can be made relatively small, the highly pressurized fuel can be stored within the pressure accumulation chamber. Also, since the timings for opening and closing the nozzle valve can be decided by the difference force between the pressure in the pressure accumulation chamber and the nozzle spring force, because a pressure of supplied fuel does not act on the upper end portion of the nozzle valve stem, the pressure variations in the inlet chamber have little affect on the fuel injection timing and the fuel injection timing can therefore be controlled more accurately.

DESCRIPTION OF THE PREFERRED EMBODIMENT

Figure 1:
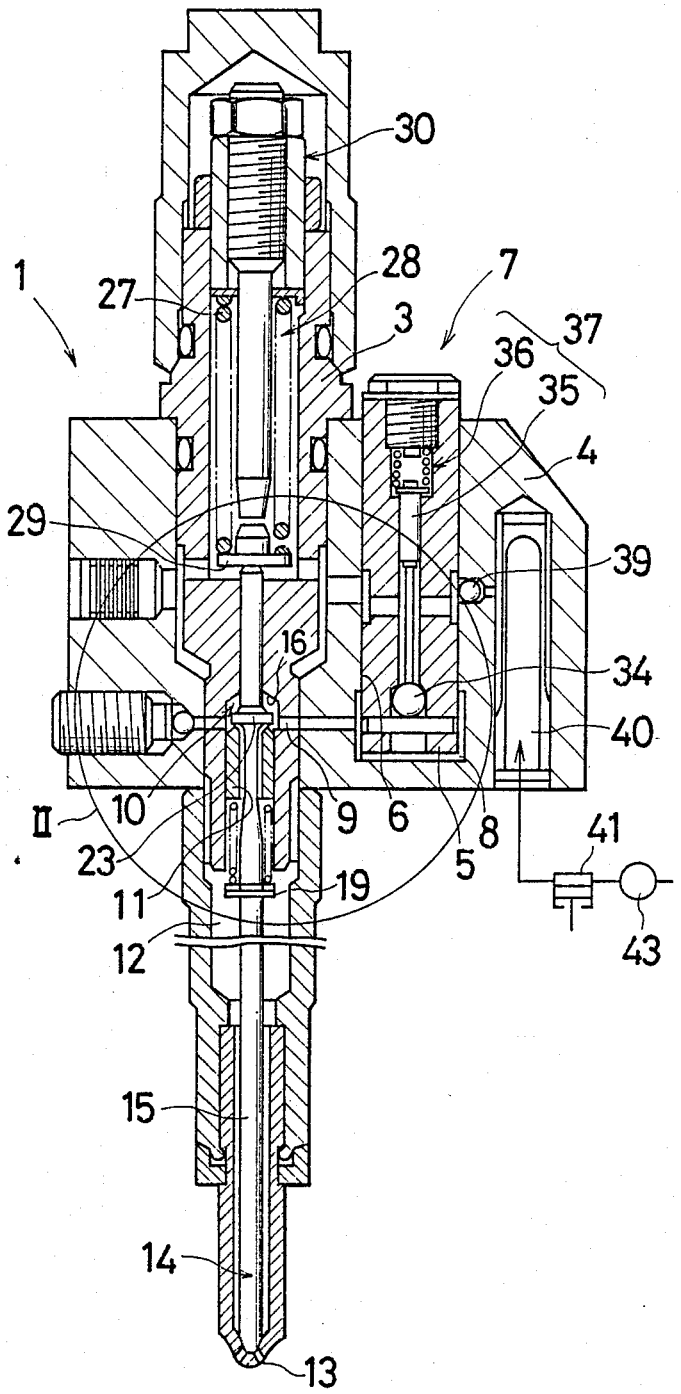
FIG. 1 is a longitudinal sectional view of a unit injector according to a preferred embodiment of the present invention.

In the drawings, a unit injector 1 has a guide hole 6 formed in a retainer block 4 which retains a plunger 5 to be guided reciprocatingly therein by a conventional drive system (not shown). A plunger pump 7 comprises the plunger 5 held hermetically and slidably in the guide hole 6. A compression chamber 8 of the plunger pump 7 is in communication with a pressure accumulation chamber 12 through a fuel inlet port 9, an inlet chamber 10 and a cylindrical check valve 11 provided in the fuel injector body 3.

In the pressure accumulation chamber 12, there is provided a nozzle valve 14 which closes fuel spray holes 13 formed at the tip portion of the fuel injector body 3. The valve stem 15 of the nozzle valve 14 extends longitudinally in the pressure accumulation chamber 12, and the upper end portion of the valve stem 15 extends hermetically and slidably in a bore 17 formed in the upper wall 16 of the inlet chamber 10. The part of the nozzle valve stem 15 that is located within the pressure accumulation chamber 12 is provided with a spring retainer 19 for a check valve spring 18, which is held between the spring retainer 19 and the lower surface of the check valve 11.

Figure 2:
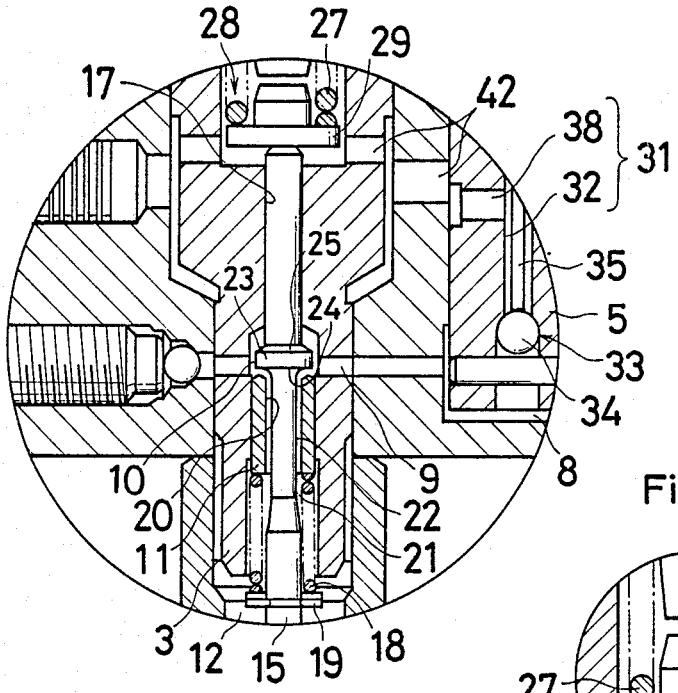
FIG. 2 is an enlarged vertical longitudinal sectional view of the II-part in FIG. 1.
Figure 3:
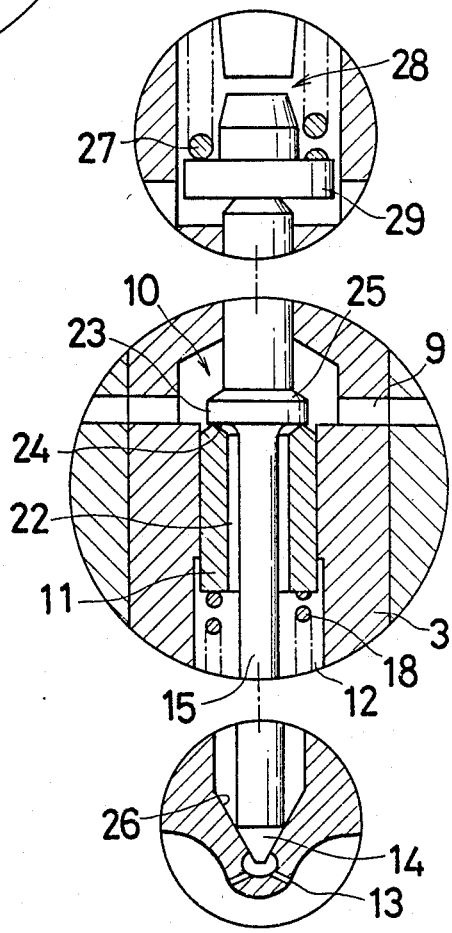
FIG. 3 is a longitudinal sectional view showing the principal parts of a fuel injector in the state wherein a pressure in a pressure accumulation chamber is lower than a predetermined pressure for a valve opening.

The cylindrical check valve 11 is fitted hermetically and slidably within the fuel injector body 3 so that the valve stem 15 of the nozzle valve 14 extends through the interior space of the check valve 11 this is in. As shown in FIGS. 2 and 3 valve stem 15 is dimensioned to maintain a fuel passageway 22 between the inside circumferential surface 20 of the check valve 11 and the outside circumferential surface 21 of the nozzle valve stem 15.

On the part of the nozzle valve stem 15 located within the inlet chamber 10, there is provided an annular projection 23, the underside of which is formed as an abutment 24 for the check valve 11 and an upper side of which is formed as a pressure receiving area 25 for closing the nozzle valve 14.

Further, above the annular projection 23, the nozzle valve 14 has a valve stem portion which is formed to have the same diameter as that of the valve stem portion located within the pressure accumulation chamber 12, so that a valve opening or closing force is not generated by the area difference between said both portions.

A nozzle spring 27 which urges the nozzle valve 14 resiliently onto the valve seat 26 within the pressure accumulation chamber 12 is mounted in a spring chamber 28 defined at the upper side of the inlet chamber 10 by partitioning off part thereof. A lower retainer 29 for the nozzle spring 27 is provided in the lower portion of the spring chamber 28 so as to be in contact with the upper end of the nozzle valve stem 15 which extends into the spring chamber 28 through the bore 17. And the spring force of the the nozzle spring 27, that is the valve closing force for the nozzle valve 14 is adapted to be adjusted by a spring force adjusting means 30 accessible from the outside of the fuel injector body 3.

In the plunger pump 7 which compresses fuel into the pressure accumulation chamber 12 of the fuel injector 2, the plunger 5 thereof has a fuel admission channel 31 formed crosswise and an inlet valve 33, of a ball valve type, disposed at the lower portion of the longitudinal channel 32 of the fuel admission channel 31, that is at the end portion of the plunger compression chamber side. In the longitudinal channel 32, there is provided a rod 35 extended therethrough so as to open the inlet valve 33 forcedly by pushing a ball valve member 34 of the inlet valve 33. The rod 35 has a portion of enlarged diameter disposed above the cross point of the cross fuel admission channel 32, which enlarged diameter portion is fitted hermetically and slidably within the longitudinal channel 32. The upper end portion of the rod 35 is biased downwards resiliently by a valve closing pressure setting spring 36 for the inlet valve 33 of which lower end is in contact with the upper end of the rod 35. Thus, a forcible valve opening means 37 for the inlet valve 33 comprises the rod 35 and the valve closing pressure setting spring 36 for the inlet valve 33.

One end of the transverse channel 38 of the cross fuel admission channel 31 is in communication with a fuel jerk pump 41 through a non-return valve 39 and a fuel filter 40, and the other end thereof is in communication with the nozzle spring chamber 28 of the fuel injector 2 via fuel communication channels 42 bored through the retainer block 4 and the fuel injector body 3 respectively. Accordingly, each charge of fuel is adapted to be supplied to the plunger compression chamber 8 and also to the nozzle spring chamber 28 from the fuel jerk pump 41. The forcible valve opening means 37 for the inlet valve 33 receives the pressure in the fuel admission channel 31 through the enlarged diameter portion of the rod 35 and closes the inlet valve 33 by pulling up the rod 35 when the force due to full pressure in the fuel admission channel 31 becomes higher than the spring force of the valve closing pressure setting spring 36 for the inlet valve 33. Thus, the force due to pressure in the nozzle spring chamber 28 has to become equal to the spring force of the valve closing pressure setting spring 36 for the nozzle spring chamber 28 to function as a fuel pressure accumulator.

In the drawings, the symbol 43 denotes a fuel metering device, which meters the fuel flow delivered from the fuel jerk pump to the plunger pump 7.

According to the fuel injection device as described above, since the pressure in the plunger compression chamber 8 decreases as the plunger 5 starts its return stroke from its bottom dead center after completion of its fuel delivery stroke, the inlet valve 33 is opened in response to the pressure difference between the pressures in the plunger compression chamber 8 and in the fuel admission channel 31 and the nozzle spring chamber 28. The fuel is admitted to flow into the plunger compression chamber 8 from the fuel admission channel 31 and the nozzle spring chamber 28, wherein the fuel at a predetermined or settled positive pressure is always stored while the plunger 5 is pushed back to its top dead center by the presence of the admitted fuel along its full stroke. Thereupon, the pressure in the nozzle spring chamber 28 becomes lower because the fuel quantity corresponding to the capacity of the plunger compression chamber 8 has flowed out of the chamber 28. Then, when the metered fuel is delivered to the nozzle spring chamber 28 from the fuel jerk pump 41, the delivered fuel flows into the nozzle spring chamber 28 so as to increase the pressure in the chamber 28 in a primary pressure rise. But, since the metered delivered fuel quantity is less than the settled quantity corresponding to the full stroke capacity of the nozzle spring chamber 28, the force due to pressure in the fuel admission channel 31 and the nozzle spring chamber 28 becomes less than the spring force of the inlet valve closing pressure setting spring 36 and the inlet valve 33 is opened forcibly.

After that, when the plunger pump 7 starts the compression stroke, the fuel in the plunger compression chamber 8 flows back towards the nozzle spring chamber 28 because of the communication among the plunger compression chamber 8, the fuel admission channel 31 and the nozzle spring chamber 28, until the pressure in each of these chamber 8, 28 and the channel 31 rises to match the degree of spring force of the inlet valve closing pressure setting spring 36. Then, when the pressures in the plunger compression chamber 8, the nozzle spring chamber 28 and the fuel admission channel 31 reach the set pressure of the inlet valve closing pressure setting spring 36, the inlet valve 33 is closed. At this stage, as the capacities of the nozzle spring chamber 28 and the fuel admission channel 31 are filled, the metered quantity of delivered fuel remains in the plunger compression chamber 8 and the remaining fuel is compressed so as to be delivered to the fuel injector 2 by the compression action of the plunger 5 after the inlet valve 33 is closed.

On the other hand, while the pressure in the pressure accumulation chamber 12 is lower than that settled by the nozzle spring 27, the fuel is never injected into the combustion chamber because the nozzle valve 14 is kept in contact with the nozzle valve seat 26, best understood with reference to FIG. 3.

Figure 4:
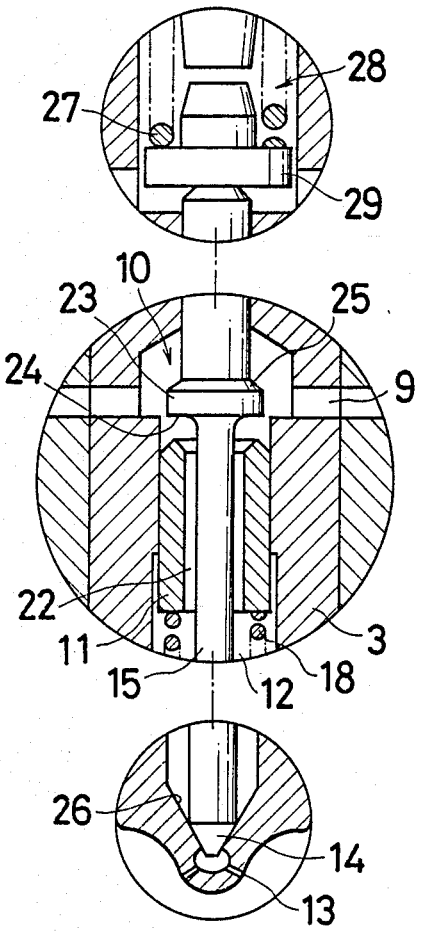
FIG. 4 is a view corresponding to FIG. 3 in the state of pressure accumulation.

As shown in FIG. 4, when the fuel delivered from the plunger pump 7 flows into the fuel injector 2, the cylindrical check valve 11 is opened by the fuel pressure against the spring force of the check valve spring 18 for the pressurized fuel to flow into the pressure accumulation chamber 12. In this case, since the spring force of the check valve spring 18 is small enough to urge the check valve 11 to the underside of the annular projection 23, the pressure of the incoming charge of fuel is not reduced greatly by the presence of the check valve. Further, even though the fuel pressure also acts on the annular projection 23 positioned within the inlet chamber 10 when the fuel flows therein, the pressure has little effect on the nozzle valve is 14 while the check valve being opened because both the upper side and the lower side surfaces of the annular projection 23 have the same area.

At the end of the delivery stroke of the plunger 5, in response to the pressure in the pressure accumulation chamber 12 and the spring force of the check valve spring 18 which acts on the underside of the check valve 11, the cylindrical check valve 11 abuts against the check valve seat 24 provided on the underside of the annular projection 23 of the nozzle valve stem 15 within the inlet valve 10 so as to block the fuel flow into the pressure accumulation chamber 12. In this case, the resultant force composed of the pressure in the pressure accumulation chamber 12 and the spring force of the check valve spring 18 acts on the nozzle valve 14 as the valve opening force, and the resultant force composed of the spring force of the the nozzle spring 27 and the fuel pressure acting on the upper surface of the annular projection 23 within the inlet chamber 10 acts as the valve closing force. The valve opening force and the valve closing force are then equally balanced with each other.

Figure 5:
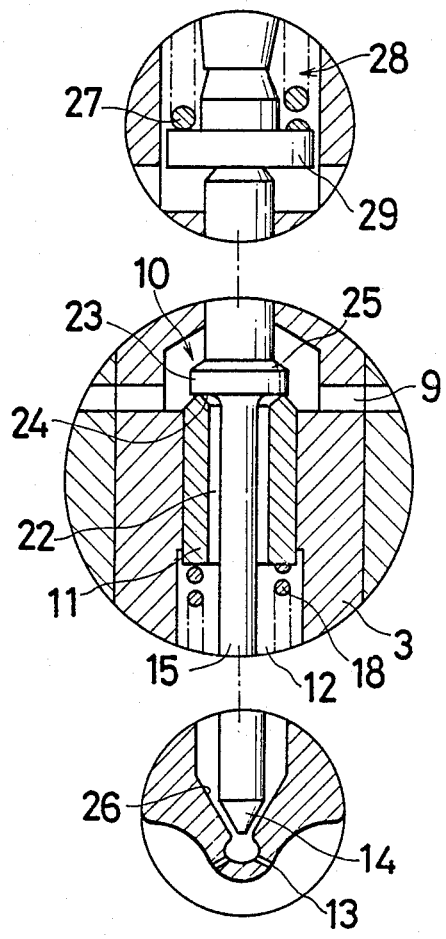
FIG. 5 is a view corresponding to FIG. 3 in the state of fuel injection.

Then, when the plunger 5 of the plunger pump 7 commences its return stroke and the pressure in the plunger compression chamber 8 decreases, as the nozzle valve closing force acting on the upside of the annular projection 23 within the inlet chamber 10 is decreased as shown in FIG. 5, the nozzle valve 14 is raised from the nozzle valve seat 26 by the difference in force between the nozzle valve opening force and the nozzle valve closing force so that the highly pressurized fuel stored in the pressure accumulation chamber 12 is injected into the combustion chamber rapidly. At that time, since the check valve spring 18 is supported on the nozzle valve stem 15 so as to move together with the nozzle valve 14, the check valve spring 18 has little effect on the nozzle valve opening force.

In addition to the device described in the above-mentioned embodiment, wherein the metered fuel is adapted to be supplied to the fuel injector of the unit injector, the present invention may also be applied to a unit injector in which fuel is supplied without being metered, as well as to a fuel injector which is connected to a plunger type of fuel injection pump through a high pressure fuel pipe.

We claim:

1. A pressure accumulation type of fuel injection device for an internal combustion engine, comprising:

a body of a fuel injector, which is provided with spray holes and a pressure accumulation chamber in communication with a delivery port of a plunger pump through an inlet chamber, said body having a bore formed in an upper wall of the inlet chamber for a nozzle valve stem to extend slidably therethrough;

a nozzle valve, which is biased towards the spray holes by a nozzle spring to selectively prevent flow of fluid through the spray holes, said nozzle valve having a valve stem which extends longitudinally through both the pressure accumulation chamber and the inlet chamber, an upper end portion of the valve stem extending hermetically and slidably through a bore of the fuel injector body;

an annular projection, formed on the valve stem within the inlet chamber and having upper and under surfaces said under surface providing a valve seat; and a check valve, selectively fluidly separating said inlet and accumulation chambers, said check valve having a cylindrical valve body that encircles the valve stem of the nozzle valve while keeping a fuel passageway between said valve stem and check valve, said check valve being fitted hermetically and slidably within the injector body, the check valve being adapted to be sealingly biased against said under surface of the annular projection by a check valve spring provided between the check valve body and the nozzle valve stem to prevent flow of fuel between the inlet and accumulation chambers when a pressure of fuel in said accumulation chamber exceeds a pressure of fuel in said inlet chamber.

2. A fuel injection device according to claim 1, wherein:

a spring chamber is defined at an upper side of the inlet chamber by partitioning off a part thereof, so that an upper end portion of the nozzle valve stem extends into the nozzle spring chamber and an upper end of the nozzle valve stem is abutted against a spring retainer for a lower end of a nozzle spring.

3. A fuel injection device according to claim 2, wherein:

a spring force adjusting means for adjusting the nozzle spring is provided at an upper portion of the fuel injector so as to be accessible from the outside thereof.

4. A fuel injection device according to claim 1, wherein:

the diameters of the nozzle valve stem, at portions thereof within the pressure accumulation chamber and above the annular projection, are the same.

5. A fuel injection device according to claim 1, wherein:

a charge of fuel delivered to the fuel injection device under pressure, metered in accordance with an engine revolution speed, is supplied to the pressure accumulation chamber.

6. A fuel injection device according to claim 5, wherein:

a non-return valve, a fuel metering accumulator and an inlet valve opening means of hydraulic control type are arranged in said order from the upstream side of a fuel flow between a fuel jerk pump, for supplying fuel to a plunger chamber of a plunger pump and an inlet valve for the plunger pump communicating with the pressure accumulation chamber.

7. A fuel injection device according to claim 6, wherein:

a nozzle spring chamber that accommodates the nozzle spring serves as the fuel metering accumulator.

* * * * *